US009919851B2

(12) United States Patent
Frosio

(10) Patent No.: US 9,919,851 B2
(45) Date of Patent: Mar. 20, 2018

(54) SINGLE DOSE BOTTLE AND RELATIVE IMPROVED MEASURING CAP

(71) Applicant: MONTEFARMACO OTC S.P.A., Bollate (IT)

(72) Inventor: Angela Frosio, Ornago (IT)

(73) Assignee: Montefarmaco OTC SpA, Bollate (IT)

( * ) Notice: Subject to any disclaimer, the term of this patent is extended or adjusted under 35 U.S.C. 154(b) by 0 days.

(21) Appl. No.: 15/121,347

(22) PCT Filed: Feb. 23, 2015

(86) PCT No.: PCT/IB2015/051352
§ 371 (c)(1),
(2) Date: Aug. 24, 2016

(87) PCT Pub. No.: WO2015/125123
PCT Pub. Date: Aug. 27, 2015

(65) Prior Publication Data

US 2017/0107028 A1 Apr. 20, 2017

(30) Foreign Application Priority Data

Feb. 24, 2014 (IT) ..... M12014A0270

(51) Int. Cl.
*B65D 51/28* (2006.01)
*B65D 41/26* (2006.01)
(Continued)

(52) U.S. Cl.
CPC ..... *B65D 51/2821* (2013.01); *A61J 1/2027* (2015.05); *A61J 1/2093* (2013.01); *B65D 1/0246* (2013.01); *B65D 41/26* (2013.01)

(58) Field of Classification Search
CPC ..... A61J 1/00; A61J 1/14; A61J 1/20; A61J 1/2024; A61J 1/2027; A61J 1/2093;
(Continued)

(56) References Cited

U.S. PATENT DOCUMENTS 2,185,699 A * 1/1940 Zeugner ..... G01F 19/00 141/381
2,804,103 A * 8/1957 Wall ..... G01F 11/262 141/381

(Continued)

FOREIGN PATENT DOCUMENTS

WO 2012140484 A1 10/2012
WO 2012175317 A1 12/2012
WO 2013171621 A1 11/2013

OTHER PUBLICATIONS

European Patent Office, International Search Report, dated May 13, 2015.

(Continued)

*Primary Examiner* — Bryon Gehman
(74) *Attorney, Agent, or Firm* — Ice Miller LLP

(57) ABSTRACT

Single-dose bottle for a fluid and a measuring cap for introducing a soluble substance in the bottle, said substance being stored in a sterile manner in a breakable capsule housed inside the measuring cap at the mouthpiece portion of the bottle; the measuring cap comprising a lower sleeve portion bottle for coupling with the neck of the bottle and an upper portion extending above the mouthpiece of the container and configured to make a seat for housing the capsule, the upper portion in turn comprising lateral walls for the at least partial lateral containment of the capsule and an upper roof portion for the upper containment of the capsule, the upper roof portion being movable by manual action of a user between a raised resting position, wherein it is in contact without compression against the capsule, and a lowered operating position wherein it compresses the capsule in a collapsed configuration.

13 Claims, 9 Drawing Sheets

(51) Int. Cl.
*B65D 1/02* (2006.01)
*A61J 1/20* (2006.01)

(58) Field of Classification Search
CPC ..... B65D 1/02; B65D 1/0246; B65D 25/08; B65D 41/26; B65D 51/24; B65D 51/28; B65D 51/2821; B65D 81/32; B65D 81/3222
USPC ..... 206/219–222; 141/381
See application file for complete search history.

(56) References Cited

U.S. PATENT DOCUMENTS 6,513,650 B2 * 2/2003 Mollstam ..... A61J 9/00 206/219
6,820,740 B1 * 11/2004 Spector ..... B65D 51/2828 206/219
6,962,254 B2 * 11/2005 Spector ..... B65D 51/2828 206/222
7,171,996 B2 * 2/2007 Perry ..... G01F 19/00 141/381
7,861,855 B2 * 1/2011 Casey ..... B65D 81/3222 206/221
8,720,680 B2 * 5/2014 Casey ..... B65D 81/3222 206/221
9,193,517 B2 * 11/2015 Fontana ..... B65D 51/2821
9,718,599 B2 * 8/2017 Casey ..... B65D 81/3222
2002/0040856 A1 4/2002 Mollstam et al.
2007/0246380 A1 * 10/2007 Esteban Villalobos ..... B65D 81/3211 206/219

OTHER PUBLICATIONS

European Patent Office, Written Opinion of the International Searching Authority, dated May 13, 2015.

* cited by examiner

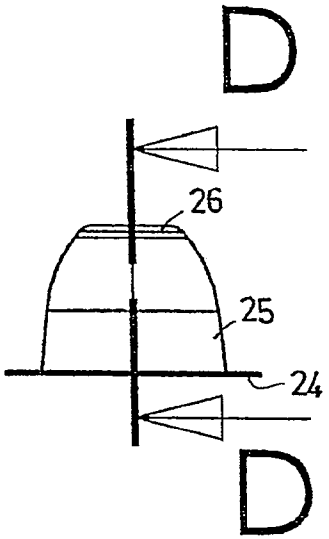
Fig.4
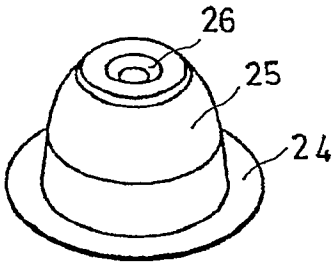
Fig.3
Fig.5
SECTION D - D
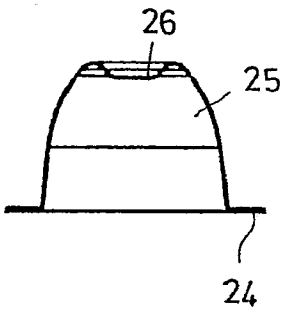

SECTION B – B

SINGLE DOSE BOTTLE AND RELATIVE IMPROVED MEASURING CAP

CROSS-REFERENCE TO RELATED APPLICATIONS

The present application is a U.S. national stage of, and claims the priority benefit of, International Patent Application Serial No. PCT/IB2015/051352, filed Feb. 23, 2015 and Italian Patent Application Serial No. MI2014A000270, filed Feb. 24, 2014, the text and drawings of which are hereby incorporated by reference in their entireties.

The present invention refers to a single-dose bottle. More in particular the present invention refers to a single-dose bottle of the type comprising a container of a fluid and a measuring cap of a soluble substance in the container housed in a capsule enclosed in the cap itself.

The present invention finally also refers to the single measuring cap that can theoretically be sold or made separately with respect to the container as well as being able to be used with containers already currently on the market.

Today, there are many known and widespread different types of single-dose bottles with measuring caps on the market in just as many different fields of application that go essentially from the pharmaceutical field to the food industry.

In general such bottles can indeed be used each time there is the need to have a predetermined mixture in a short time and to be able to preserve the components separate from one another for a long time.

The need of mixing the two components in a practical and quick manner just before the moment and at the place of use comes from the fact that otherwise, if the substance was already mixed and ready to use, it would lose therapeutic power.

Usually these single-dose bottles comprise a container of a fluid and a measuring cap that houses a capsule made of a soluble substance inside it.

The measuring caps are provided with a lower coupling portion with the neck of the container and an upper portion that is configured so as to make a housing seat for the capsule.

The upper portion in turn comprises side walls for the at least partial lateral containment of the capsule and an upper closure portion.

In particular the upper portion is movable by the manual action of a user between a raised resting position, in which the capsule is kept intact in the cap, and a lowered operating position in which the breaking of the capsule and the dispensing of the substance into the container is commanded.

Therefore, as it is known, it is sufficient to act manually on the cap in order to proceed with the dispensing of the substance contained in the capsule into the container.

Currently, the capsule can be broken in two different ways.

The first way provides that the lateral walls of the mobile part of the cap break through the capsule passing through it during the manual action on the upper portion of the cap.

The second way provides that the lateral walls penetrate inside the cap without passing through the capsule but compressing it until the bottom breaks.

Well, neither of said two solutions used today are completely optimal in terms of hygiene.

Indeed, as it will now be shown, in both cases there is a sort of contamination from outside to the environment inside the cap that is kept isolated until the cap itself moves.

Specifically, in the first embodiment described the outer walls of the cap, per se exposed to the external environment, come into direct contact with the substance to be dispensed unavoidably contaminating it. In the second case the contamination does not occur in a direct manner, i.e., through the direct contact of exposed walls and of the substance to be dispensed, but rather in an indirect manner since the walls, which penetrate in any case inside the cap, provide for breaking only the lower part of the capsule leaving the upper face intact.

Starting from such a prior art the purpose of the present invention is that of making a single-dose bottle with a dispensing cap that is a particularly efficient alternative to those known.

According to the more general aspect of the invention these purposes are achieved thanks to a dispensing cap in which no portion that is exposed to the surrounding environment penetrates inside the cap itself when the substance contained in the capsule is dispensed.

According to the preferred embodiment of the invention, and shown in the figures, the measuring cap comprises:

- a lower sleeve portion that is provided with means for coupling with the neck of the container and
- an upper portion that extends above the mouthpiece of the container that is configured to make a seat for housing a capsule.

In such a structure the upper portion in turn comprises lateral walls for the at least partial lateral containment of the capsule and an upper roof portion for the upper containment of the capsule which is movable by the manual action of a user between:

- a raised resting portion, in which it is in contact without compression against the capsule, and
- a lowered operating position in which it compresses the capsule in a collapsed configuration.

Advantageously, the lateral walls are configured in such a way that during compression of the upper roof portion they do not penetrate inside the measuring cap but rather switch from a substantially extended configuration to a configuration in which they are laterally bent on themselves.

Such a movement of the walls from the extended configuration to the laterally bent configuration is moreover facilitated by providing the walls with a dome-like shape with a plurality of openings.

Finally, the upper roof portion is provided with a lowered centre that facilitates the manual compression of the cap.

Further characteristics of the invention shall of course be highlighted in the dependent claims.

The characteristics and the advantages of a bottle with a measuring cap according to the present invention shall become clearer from the following description, given as an example and not for limiting purposes, with reference to the attached schematic drawings, in which:

FIGS. 3-5 show a capsule that is particularly suitable for the bottle of FIG. 1;

Figure 1:
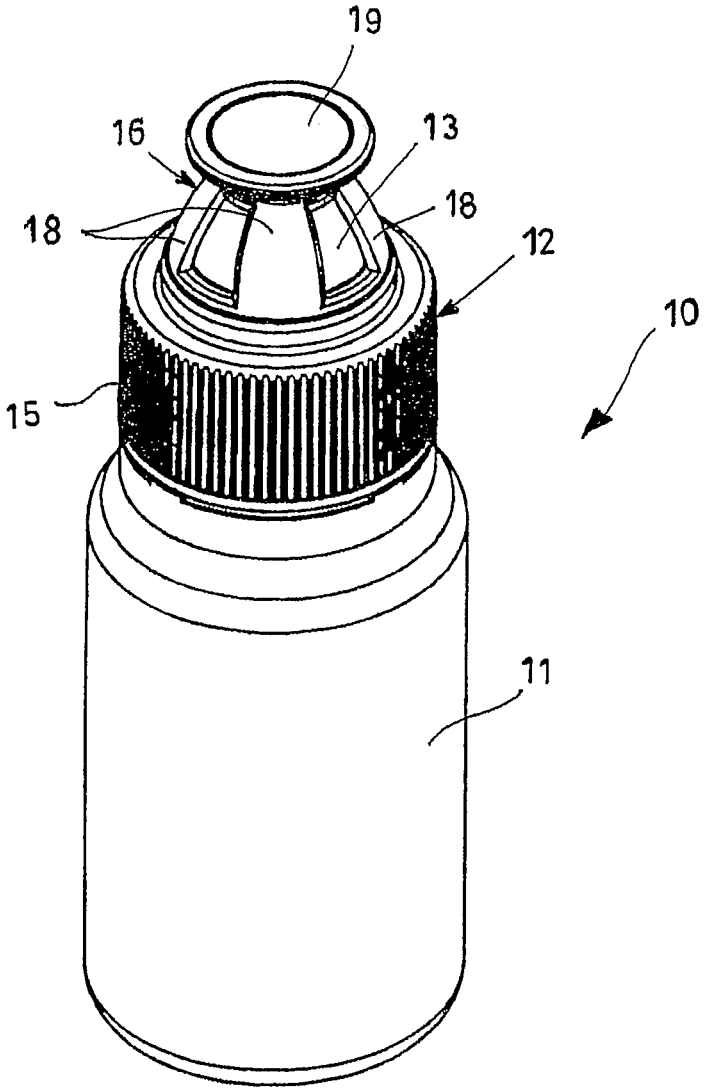
FIG. 1 shows a perspective view of an embodiment of a bottle according to the present invention in the resting condition with the capsule intact.
Figure 2:
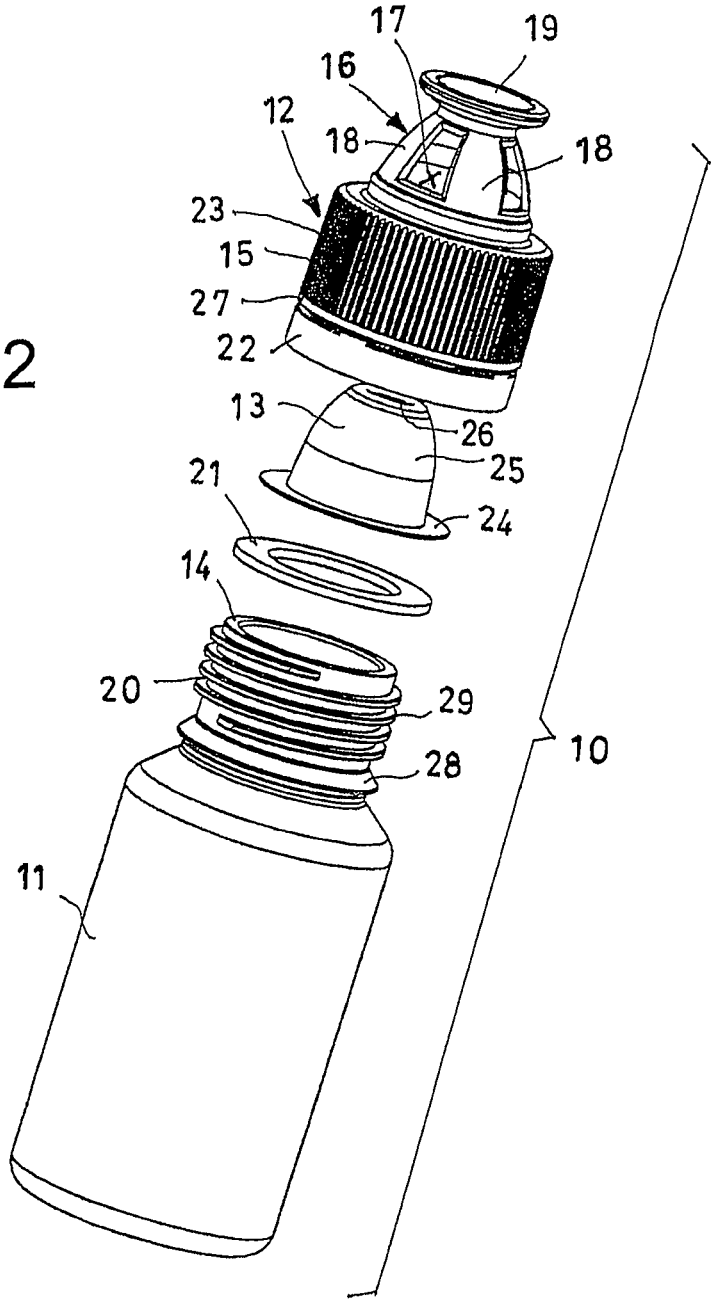
FIG. 2 shows an exploded view of the bottle of FIG. 1.
Figure 7:
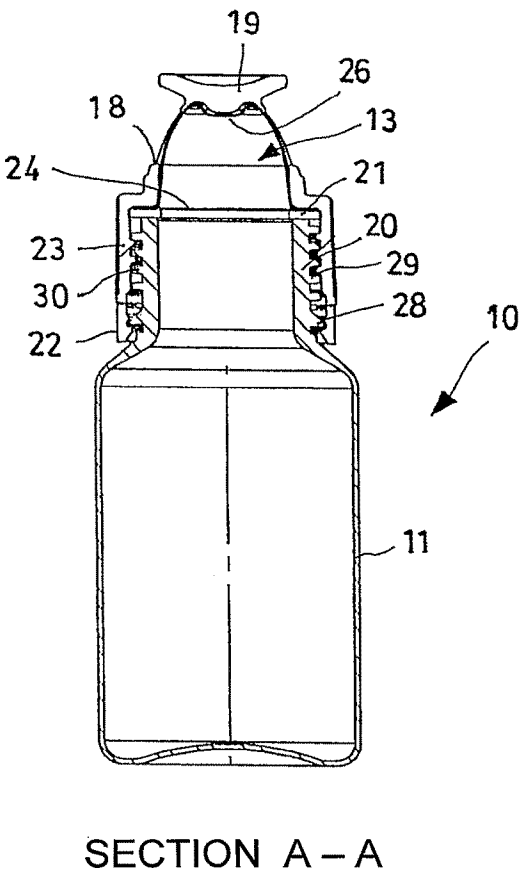
FIG. 7 shows a section view of the bottle of FIG. 6 along the lines A-A.
Figure 6:
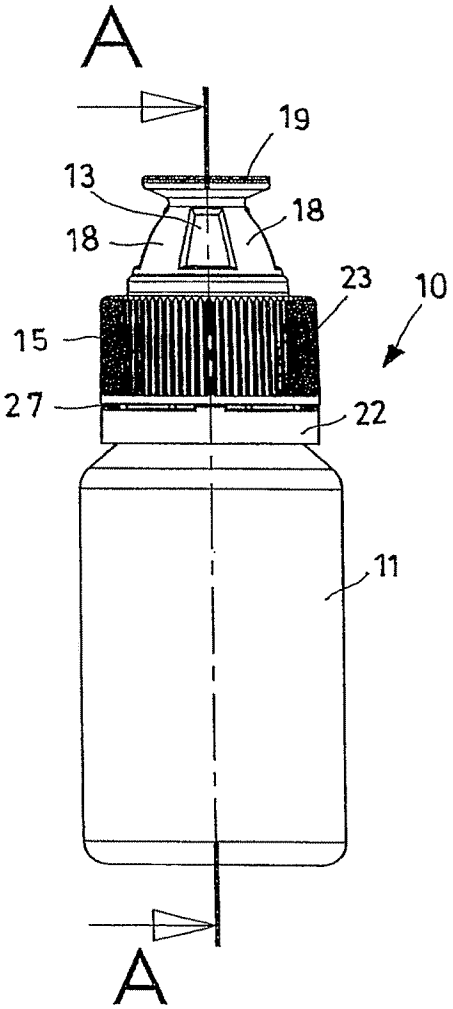
FIG. 6 shows a side view of the bottle of FIG. 1.

With reference to the figures, reference numeral 10 shows a single-dose bottle according to the present invention and reference numeral 12 shows the relative cap for dispensing the substance contained in the capsule 13 enclosed in the cap itself.

By capsule 13 it is meant also cartridges and/or other containers that act in the same way as the capsule 13.

Such a single-dose bottle 10 is of the type comprising:

a container 11 of a fluid and a measuring cap 12 of a soluble substance that is kept in a sterile manner in a breakable capsule 13 that is housed inside the measuring cap 12 itself at the mouthpiece portion 14 of the container 11.

By sterile it is meant in general that the capsule 13 is protected from foreign agents at least with reference to humidity.

In particular, the measuring cap 12 comprises:

a lower sleeve portion 15 that is provided with means for coupling with the neck 20 of the container 11 and an upper portion 16 that extends above the mouthpiece of the container 11 that is configured to make a seat 17 for housing the capsule 13.

The upper portion 16 in turn comprises:

lateral walls 18 for the at least partial lateral containment of the capsule 13 and an upper roof portion 19 for the upper containment of the capsule 13.

The upper roof portion 19 is movable by the manual action of a user between:

a raised resting position, wherein it is in contact without compression against the capsule 13, and a lowered operating position in which it compresses the capsule 13 in a collapsed configuration.

According to the invention the lateral walls 18 are configured in such a way that during compression of the upper roof portion 19 against the capsule 13 they do not penetrate inside the measuring cap 12 but rather switch from a substantially extended configuration, when the upper roof portion 19 is in the raised position, to a configuration that is substantially laterally bent on themselves when the upper roof portion 19 is in a lowered position.

Figure 8:
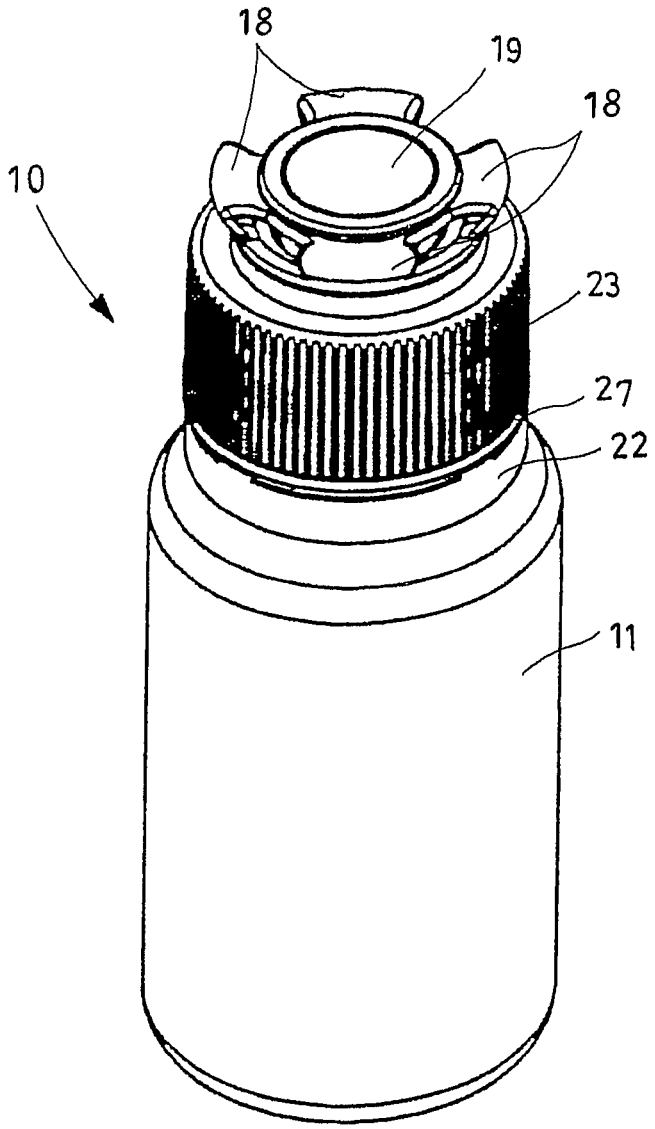
FIG. 8 shows a perspective view of the bottle of FIG. 1 in the operating condition with the capsule that is exploded.
Figure 9:
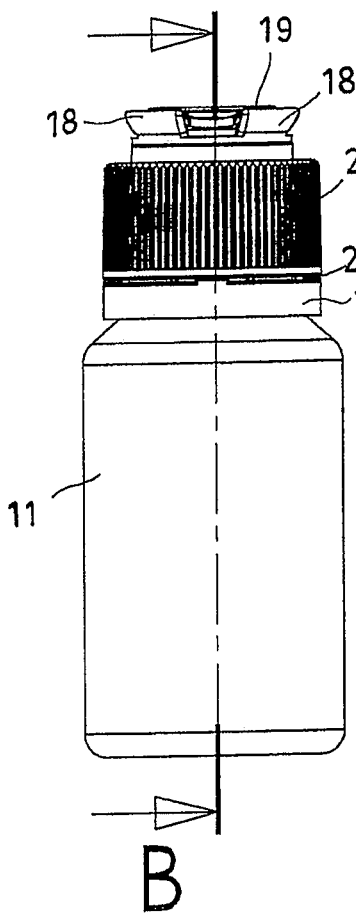
FIG. 9 shows a side view of the bottle of FIG. 8.
Figure 10:
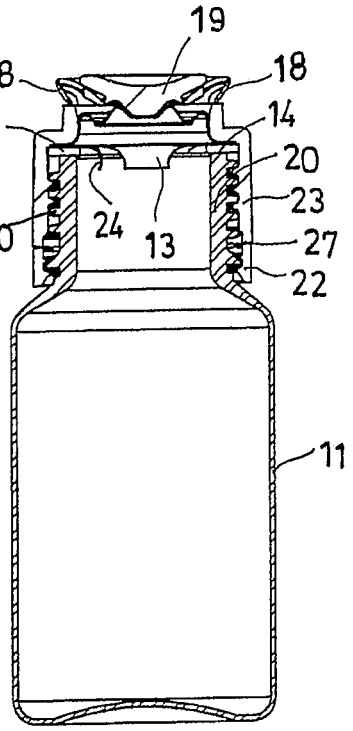
FIG. 10 shows a section view of the bottle of FIG. 9 along the lines B-B.
Figure 11:
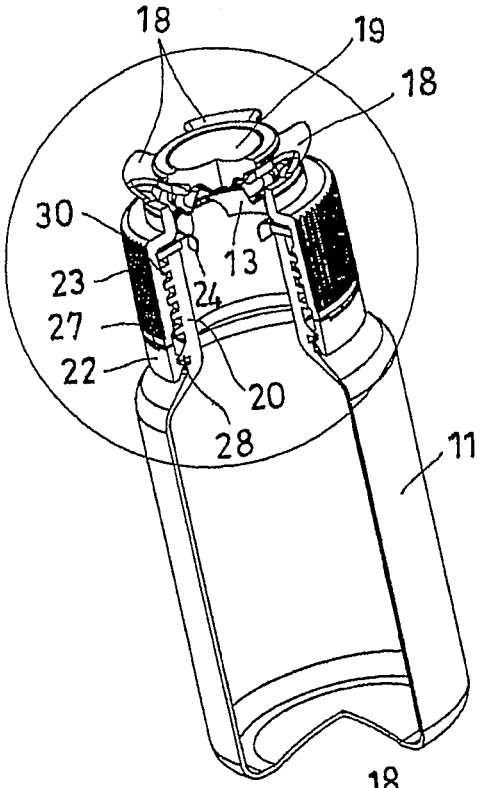
FIG. 11 shows a broken perspective view of the bottle of FIG. 1 in operating conditions with the capsule exploded.
Figure 12:
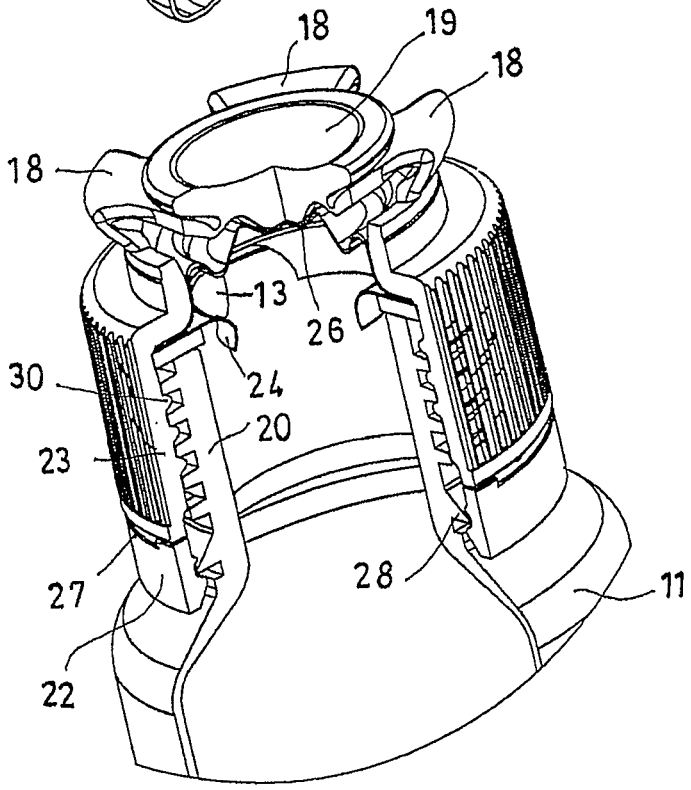
FIG. 12 shows an enlarged detail of FIG. 11.

For example in FIG. 8 it is possible to see such a laterally bent configuration of the lateral walls 18, in which said lateral walls 18 are actually bent externally with respect to the capsule 13.

The thing that facilitates such a configuration is the fact that the upper portion 16 of the measuring cap 12 is dome-shaped and in which the upper roof portion 19 is made in the shape of a circular enlarged portion that projects with respect to the walls 18.

The structure is made even more yieldable and functional for the required purpose, in the sense that less force is required in order to penetrate the capsule, providing that the walls 18 have a series of openings 17 or windows.

Furthermore, such windows make the type of internal capsule to be visible, which can have different colours according to the cases, or making it easier to access and recognise the indication of an expiry date.

The actuation of the cap and the compression of the capsule are facilitated respectively by the fact that the upper roof portion 19 comprises a lowered portion for receiving the user's thumb and by the fact that the capsule 13 is in turn dome-shaped with an enlarged base 24 and with an upper portion 26 that is provided with a central concavity for receiving the lowered portion of the upper roof portion 19.

In FIGS. 1 to 12 the upper roof portion 19 does not have the internal punch and collaborates directly with the capsule at the inner face of the lowered portion for receiving the thumb.

Figure 14:
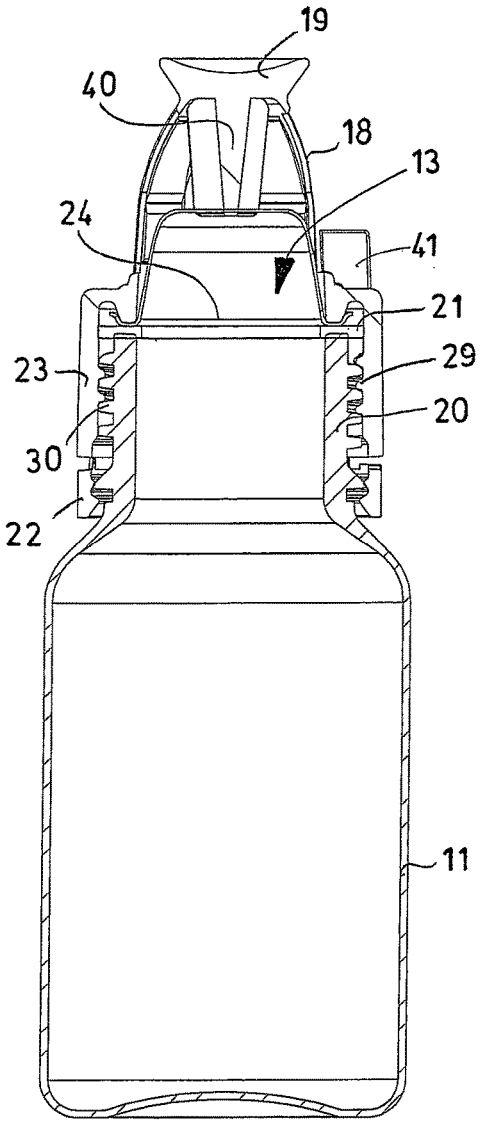
FIGS. 13 and 14 show a different embodiment of a bottle according to the present invention.
Figure 13:
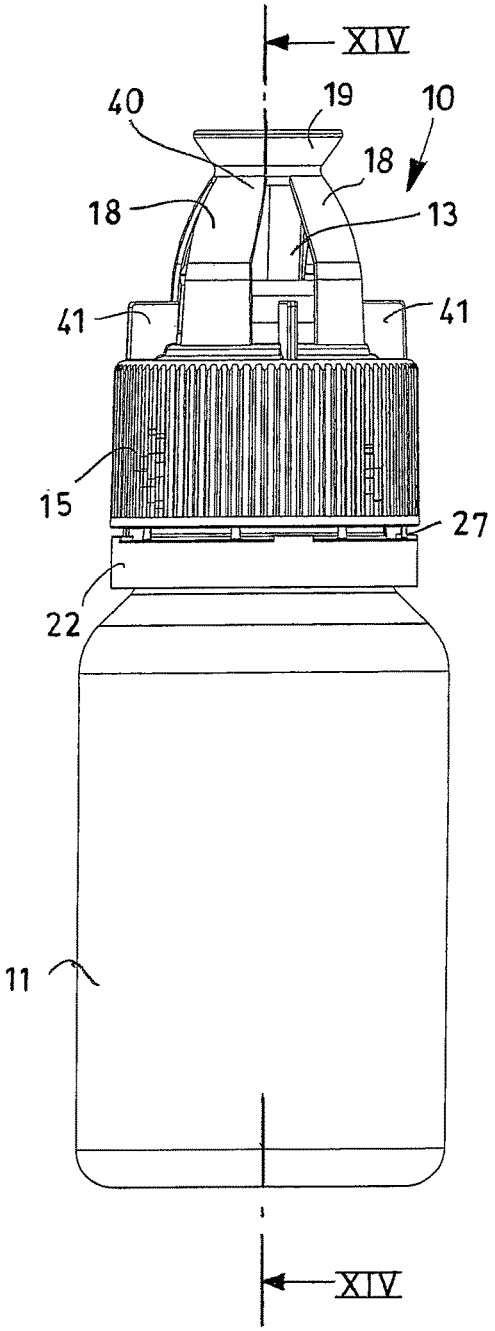

Alternatively, FIGS. 13 and 14 show an embodiment in which the upper roof portion 19 is provided with an internal punch 40. In such a case it is the punch 40 that compresses the capsule 13 when using the bottle.

Of course, also in this last case the lateral walls 18 operate in the same way as described previously or rather they laterally bend on themselves when the upper roof portion 19 is in a lowered position.

In said figures the punch is made in the shape of a cross, but it can also have any other shape.

It can also be provided for there to be a sealing ring 21 arranged between the mouthpiece 14 of the container 11 and the enlarged base 24 of the capsule 13.

To finish off the invention there are some constructive aspects like the fact of providing the sleeve portion 15 divided into two portions, a lower portion 22 and an upper portion 23, which are connected by a prepared breaking area 27.

The lower portion is fixedly connected to the neck 14 by a lip 28 that is integral with the neck itself whereas the upper portion 23 provides an internal thread 30 that is coupled with the thread 29 of the neck 20.

In such a way, by rotating the cap, the two sleeve portions 15 are torn removing the cap 12 and allowing the user to drink the mixture that has just been formed.

Figure 15:
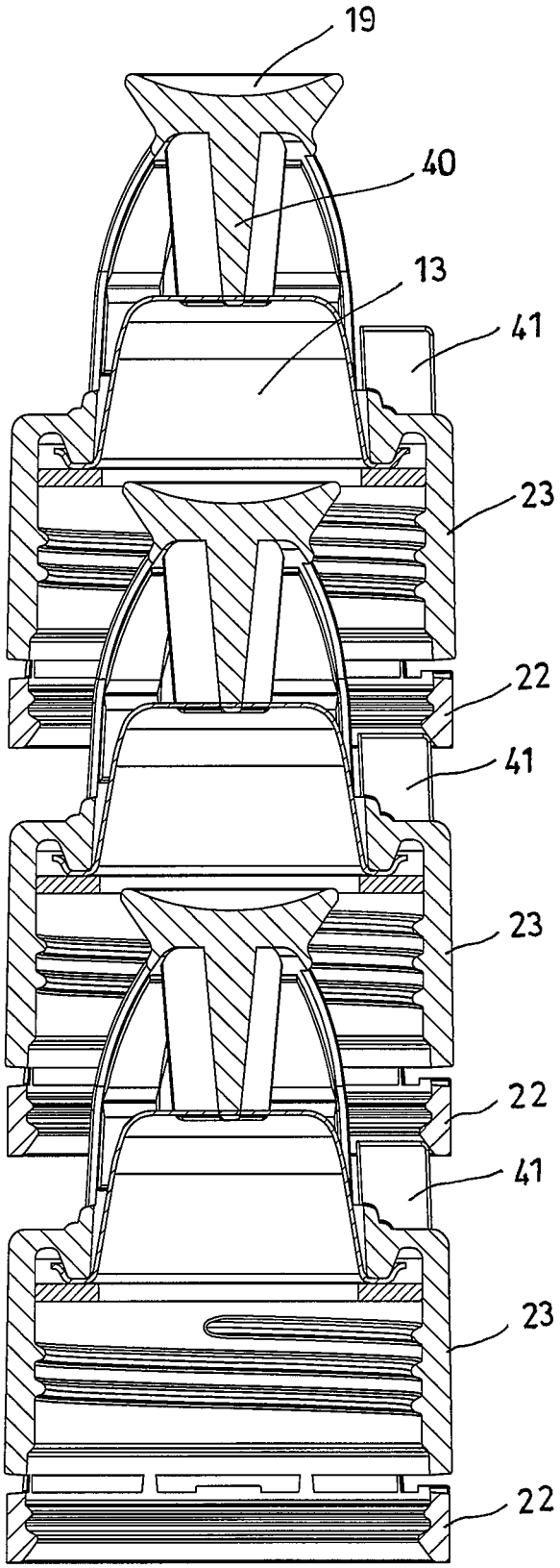
FIG. 15 shows the possible configuration of two caps, in which the breakage of the cap is preserved.

Lastly, above the lower sleeve portion 15, and substantially laterally with respect to the upper portion 16 for containing the capsule 13, spacer elements 41, such as a plurality of vertical rods 41, can be provided for preventing the capsule 13 from accidentally breaking when storing the caps. Indeed, as can be seen in FIG. 15, in the case of accidental interpenetration of two caps, the lower portion 22 abuts against such rods 41 so as to avoid compression acting on the upper portion 19 that could lead to premature breaking of the capsules 13.

It has thus been seen that the single-dose bottle and the relative dispensing cap according to the present invention achieve the previously highlighted purposes offering not only a valid alternative to bottles known today but also making an almost complete barrier with respect to humidity and providing an extremely easy to use system providing that no outer wall penetrates inside the cap itself.

Other advantages are worth mentioning for example the fact of being able to increase the height of the internal capsule, which could also contain substances in the liquid form, and achieve a larger mixing chamber.

Finally, use of plastic material is reduced and the various elements that form the bottle are made recyclable in an independent manner being it possible to separate the aluminium from the plastic.

The single-dose bottle and the relative dispensing cap of the present invention thus conceived are subject to numerous modifications and variants, all covered by the same inventive concept; moreover, all the details can be replaced by technically equivalent elements. In practice, the materials used, as well as their dimensions, can be of any type according to the technical requirements.

The invention claimed is:

1. Single-dose bottle (10) comprising a container (11) for containing a fluid and a measuring cap (12) for measuring a soluble substance in said container (11), the soluble substance being stored in a sterile manner in a breakable capsule (13) housed inside said measuring cap (12) at a mouthpiece portion (14) of said container (11); said measuring cap (12) comprising a lower sleeve portion (15) provided with means for coupling with the neck (20) of said container (11) and an upper portion (16) extending above said mouthpiece portion (14) of said container (11) and configured to make a seat (17) for housing the capsule (13), said upper portion (16) in turn comprising lateral walls (18) for the at least partial lateral containment of the capsule (13) and an upper roof portion (19) for the upper containment of the capsule (13), said upper roof portion (19) being movable by the manual action of a user between a raised resting position, wherein it is in contact without compression against the capsule (13), and a lowered operating position wherein it compresses the capsule (13) in a collapsed configuration, characterised in that said lateral walls (18) are configured in such a way that, during compression of said upper roof portion (19) they do not penetrate into said measuring cap (12), said lateral walls switching from a substantially extended configuration when said upper roof portion (19) is in a raised position, to a configuration in which they are substantially laterally bent on themselves when said upper roof portion (19) is in a lowered position.

2. Single-dose bottle (10) according to claim 1 characterised in that said upper portion (16) of said measuring cap (12) is dome-shaped wherein the upper roof portion (19) is made in the shape of a circular enlarged portion projecting with respect to said walls (18).

3. Single-dose bottle (10) according to claim 2 characterised in that said walls (18) define a series of openings (17).

4. Single-dose bottle (10) according to claim 1 characterised in that said upper roof portion (19) comprises a lowered portion for receiving the user's thumb.

5. Single-dose bottle (10) according to claim 4 characterised in that said upper roof portion (19) internally comprises a punch (40) facing said capsule (13).

6. Single-dose bottle (10) according to claim 4 characterised in that said capsule (13) is dome-shaped comprising an enlarged base portion (24), arranged at said mouthpiece (14) of said container (11), inclined walls (25) and an upper portion (26) provided with a central concavity for receiving said lowered portion of said upper roof portion (19) or said punch (40).

7. Single-dose bottle (10) according to claim 4 characterised in that it comprises a sealing ring (21) arranged between said mouthpiece portion (14) of said container (11) and said enlarged base (24) of said capsule (13).

8. Single-dose bottle (10) according to claim 1 characterised in that it comprises spacer elements (41) arranged above said lower sleeve portion (15) and substantially laterally to said upper portion (16).

9. Measuring cap (12) for a single-dose bottle (10) configured for housing a breakable capsule (13) inside it; said measuring cap (12) comprising a lower sleeve portion (15) provided with means for coupling with a container (11) and an upper portion (16) configured to make a seat (17) for housing the capsule (13) wherein said upper portion (16) in turn comprises lateral walls (18) for the at least partial lateral containment of the capsule (13) and an upper roof portion (19) for the upper containment of the capsule (13), said upper roof portion (19) being movable by the manual action of a user between a raised resting position, wherein it is in contact without compression against the capsule (13), and a lowered operating position wherein it compresses the capsule (13) in a collapsed configuration, characterised in that said lateral walls (18) are configured in such a way that, during compression of said upper roof portion (19), do not penetrate into said measuring cap (12), said lateral walls switching from a substantially extended configuration when said upper roof portion (19) is in a raised position, to a configuration in which they are substantially laterally bent on themselves when said upper roof portion (19) is in a lowered position.

10. Measuring cap (12) according to claim 9 characterised in that said upper portion (16) is dome-shaped wherein the upper roof portion (19) is made in the shape of a circular enlarged portion projecting with respect to said walls (18).

11. Measuring cap (12) according to claim 10 characterised in that said walls (18) define a series of openings (17).

12. Measuring cap (12) according to claim 10 characterised in that said upper roof portion (19) comprises a lowered portion for receiving the user's thumb.

13. Measuring cap (12) according to claim 12 characterised in that said upper roof portion (19) internally comprises a punch (40).

* * * * *